United States Patent [19]

Hershberger

[11] Patent Number: 4,504,966

[45] Date of Patent: Mar. 12, 1985

[54] STEREO INHIBITOR FOR AM STEREO RECEIVER

[75] Inventor: David L. Hershberger, Quincy, Ill.

[73] Assignee: Harris Corporation, Melbourne, Fla.

[21] Appl. No.: 499,551

[22] Filed: May 31, 1983

[51] Int. Cl.[3] ..... H04H 5/00

[52] U.S. Cl. ..... 381/15

[58] Field of Search ..... 307/512, 518, 520, 360; 381/11, 13, 15, 16, 94; 455/159, 194, 212, 213, 218, 222-224, 306

[56] References Cited

U.S. PATENT DOCUMENTS

| | | | |
|---|---|---|---|
| 3,634,626 | 1/1972 | Staley | 381/11 |
| 3,896,386 | 7/1975 | Ohsawa | 455/159 |
| 3,944,749 | 3/1976 | Kahn | 381/15 |
| 3,979,679 | 9/1976 | Bush et al. | 455/213 |
| 3,999,132 | 12/1976 | Smith | 455/156 |
| 4,038,604 | 7/1977 | Koerber | 455/212 X |
| 4,093,824 | 6/1978 | Grosjean | 455/222 X |
| 4,159,398 | 6/1979 | Hilbert et al. | 381/16 |
| 4,192,968 | 3/1980 | Hilbert et al. | 381/15 |
| 4,232,393 | 11/1980 | Kumaoka et al. | 455/212 X |
| 4,245,348 | 1/1981 | Imazeki | 455/194 X |
| 4,301,541 | 11/1981 | Tanaka et al. | 455/221 |
| 4,302,626 | 11/1981 | Streeter | 381/15 |
| 4,306,112 | 12/1981 | Ueno | 381/13 |
| 4,379,208 | 4/1983 | Isbell et al. | 381/15 |

FOREIGN PATENT DOCUMENTS

| | | | |
|---|---|---|---|
| WO82/01291 | 4/1982 | PCT Int'l Appl. | 381/11 |
| 2099265 | 12/1982 | United Kingdom | 381/11 |

OTHER PUBLICATIONS

Harris Corp. Comments to the FCC's Notice of Proposed Rulemaking re AM Stereo (Comments Filed May 15, 1979), p. 73.

Mennie, "AM Stereo: Five Competing Options", IEEE Spectrum, Jun. 1978, pp. 24-31.

*Primary Examiner*—Thomas W. Brown
*Assistant Examiner*—W. J. Brady
*Attorney, Agent, or Firm*—Yount & Tarolli

[57] ABSTRACT

An AM stereo demodulator having monophonic and stereophonic modes of operation and adapted to demodulate a QAM signal whose quadrature-phase signal has a low frequency slot containing substantially no information signal therein. The demodulator includes a low-pass filter for filtering the quadrature-phase signal so as to provide a filtered signal containing only signals in the low frequency slot of the quadrature-phase signal. A window comparator compares the amplitude of the filtered signal with two threshold levels and provides a first output signal when the filtered signal is outside of the range bounded by the threshold levels. A circuit is included for placing the AM stereo demodulator in the monophonic mode of operation in response to the first output signal.

5 Claims, 2 Drawing Figures

STEREO INHIBITOR FOR AM STEREO RECEIVER

BACKGROUND AND FIELD OF THE INVENTION

The present invention relates to AM stereo receivers, and more particularly to a circuit for inhibiting stereo operation under certain signal conditions.

A number of different signal formatting schemes have been proposed for encoding stereo information on a carrier in the AM radio broadcasting band. In one scheme, the transmitter broadcasts what is essentially a quadrature AM (QAM) signal. A signal corresponding to the sum of the two stereo signals (i.e., L+R) is transmitted in the in-phase or I channel, and the difference between the two stereo signals (i.e., L−R) is transmitted in the quadrature or Q channel.

The QAM signal can be modified in any of a number of ways to enhance compatibility with standard monophonic receivers. For example, the gain of the Q channel signal can be maintained at a fixed level substantially below the gain of the I channel signal, or can be dynamically varied in accordance with a criterion representative of short term compatibility of the total signal with existing monophonic receivers. Alternatively, the quadrature channel can be left at full gain, but amplitude limitations applied to the L and R stereo signals so as to achieve improvements in compatibility.

Unnecessarily high levels of noise will be present in the output signals provided by a stereo receiver if it is operated in a stereo mode when receiving a conventional monophonic signal. Consequently, stereo radio receivers conventionally include circuitry for switching the receiver to a stereophonic mode of operation only when a pilot signal transmitted as part of the stereo signal is found to be present in the received signal. The same circuitry switches the receiver back to a monophonic mode of operation if the pilot signal disappears for some reason. Such circuitry thus prevents the receiver from operating in a stereophonic mode when no stereophonic information is present in the signal being received.

It would be desirable to also switch the receiver to a monophonic mode of operation when the received signal, although including stereo information, also included substantial interference. When there is significant interference, more noise free operation can be obtained in the monophonic mode. Interference in the received signal cannot be readily detected, however.

SUMMARY OF THE INVENTION

It is an object of the present invention to provide a demodulator for use in an AM stereo receiver, wherein the demodulator includes means for inhibiting the stereophonic mode of operation under certain circumstances.

It is another object of the present invention to provide a new AM stereo demodulator including circuitry for detecting interference in the received signal, and for switching the demodulator to a monophonic mode of operation in the event the interference exceeds a predetermined threshold level.

It is still another object of the present invention to provide an AM stereo demodulator for detecting the amount of noise or interference present in an otherwise empty frequency slot in the received AM stereo signal.

It is yet another object of the present invention to provide a circuit for switching the stereo demodulator to a monophonic mode of operation in the event that interference or other noise signals are present within a frequency slot of the received AM stereo signal which would ordinarily be empty.

In accordance with the present invention, apparatus is provided for use in a QAM stereo demodulator having monophonic and stereophonic modes of operation and adapted to demodulate a quadrature AM stereo signal whose quadrature channel has a frequency slot which is normally empty. The apparatus comprises means for detecting the presence of signals in the ordinarily empty frequency slot in the quadrature channel of the QAM signal, and means for holding the demodulator in the monophonic mode of operation if the signals in that frequency slot exceed a preset threshold.

BRIEF DESCRIPTION OF THE DRAWINGS

The foregoing and other objects and advantages of the present invention will become more readily apparent from the following detailed description, as taken in conjunction with the accompanying drawings, wherein.

DETAILED DESCRIPTION

Figure 1:
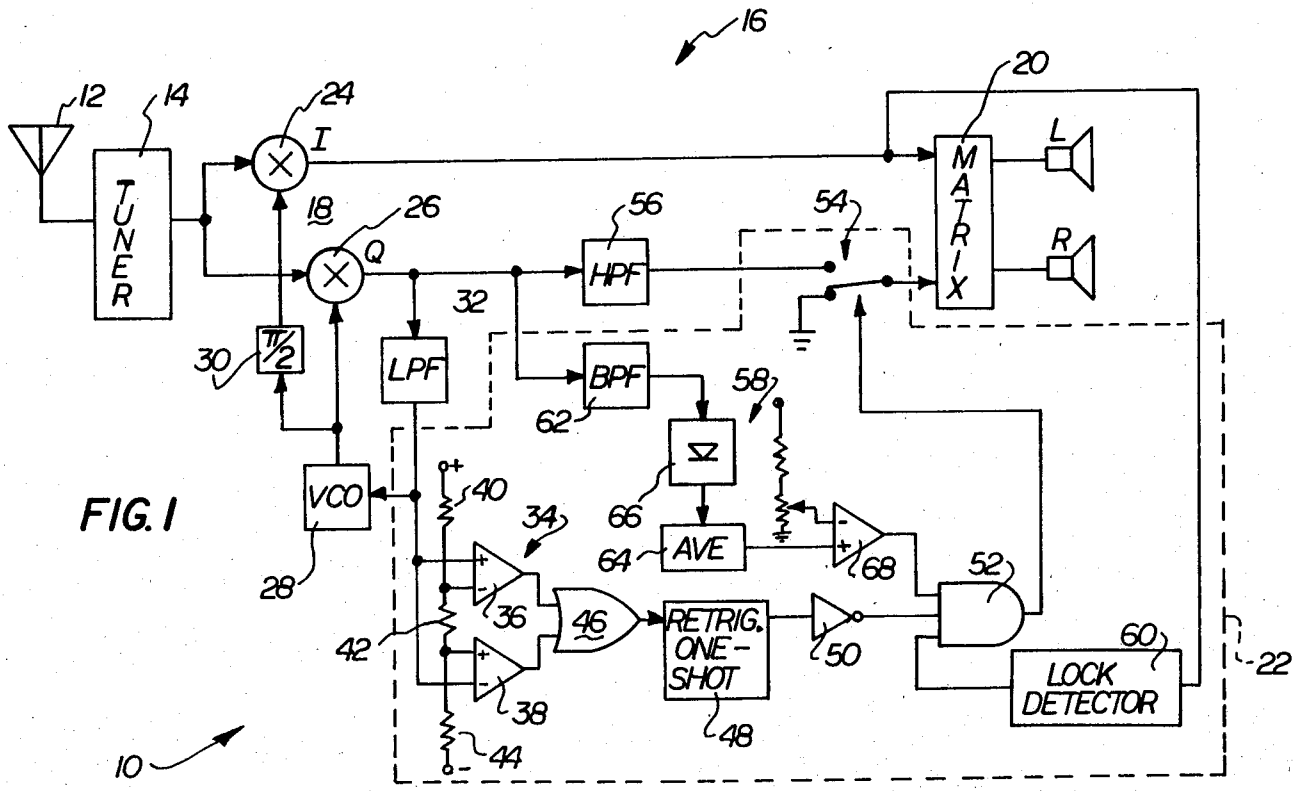
FIG. 1 is a block diagram of an AM stereo receiver incorporating the stereo inhibitor of the present invention.

FIG. 1 illustrates a quadrature AM receiver incorporating a stereo inhibitor for inhibiting the stereophonic mode of operation under certain circumstances. The QAM receiver 10 generally includes an antenna 12 for receiving the RF signals which are to be demodulated, a tuner 14 for shifting the frequency of the RF signals to a standard IF (intermediate frequency), and a stereo demodulator 16. The stereo demodulator 16 comprises a QAM demodulator 18 for recovering the I and Q channel signals from the IF signal, an audio matrix circuit 20 for adding the I and Q signals to recover one of the stereo signals (L) and for subtracting the I and Q signals to recover the other of the two stereo signals (R), and a stereo inhibitor circuit 22.

The QAM demodulator 18 includes two multipliers 24 and 26, each having the IF signal applied to one input and an IF phase reference signal applied to its other input. The phase reference signals provided to the two multipliers 24 and 26 are 90° out of phase, so that the two multipliers demodulate IF signal components which are in a quadrature phase relationship with one another. A voltage controlled oscillator (VCO) 28 provides fixed amplitude IF phase reference signals to the multipliers. The output of oscillator 28 is applied directly to multiplier 26, and indirectly to multiplier 24 through a 90° phase shift circuit 30.

VCO 28 is biased so that it generates an IF frequency signal at its output. The VCO includes a control input, however, and adjusts the actual frequency of the output signal above or below the IF frequency in accordance with the voltage applied to the control input. The output of the quadrature channel multiplier 26 is fed back to the control input of VCO 28 through a loop filter 32. The loop filter 32 is a low-pass filter. The multiplier 26, oscillator 28 and loop filter 32 form a phase locked loop. The loop automatically adjusts the frequency and phase of the signal provided by VCO 28 such that the DC signal at the output of the quadrature multiplier 26 is zero. This only occurs when the signal at the output of VCO 28 is synchronized in frequency and phase with the suppressed carrier of the quadrature channel. The multipliers 24 and 26 then provide output signals corresponding to the in-phase modulating signal (I) and quadrature-phase modulating signal (Q), respectively.

Figure 2:
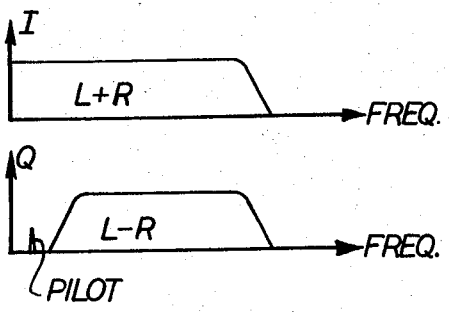
FIG. 2 is a frequency diagram illustrating the frequency spectrum of the QAM stereo signal which the AM stereo receiver of FIG. 1 is adapted to receive.

FIG. 2 shows the frequency distribution of the I and Q signal carried in the in-phase and quadrature-phase channels of the AM stereo signal which is to be demodulated by the receiver of FIG. 1. The signal in the in-phase channel is the sum of the two stereophonic signals (i.e., the L signal and the R signal). The sum signal extends from nearly DC to 15 kHz without any empty frequency slots. The signal in the quadrature-phase channel is the difference between the two stereophonic signals, however the difference signal does not cover the entire frequency spectrum from zero to 15 kHz. Instead, a narrow frequency slot from zero to approximately 200 Hz is largely empty, except for a stereo pilot signal located at a frequency of approximately 55 Hz. Since the 0–200 Hz frequency slot of the Q signal is normally almost empty, the presence of noise or co-channel interference within that frequency slot can be readily detected. This is one of the functions performed by the stereo inhibitor circuit 22.

In order to detect the presence of noise or co-channel interference within the low frequency slot in the quadrature channel, the low frequency slot is first isolated by filtering out everything in the quadrature channel having a frequency equal to or greater than the pilot signal. A separate low-pass filter may be provided for this function. It has been found, however, that the loop filter 32 associated with the phase locked loop is quite suitable for this purpose. The output of low-pass filter 32, which includes only low frequency signals in the Q channel, is applied to a window comparator 34. The window comparator compares the signal at the output of low-pass filter 32 with preselected positive and negative threshold levels representative of the maximum positive and negative amplitudes which signals in the low frequency slot of the Q channel can reach before causing the stereo inhibitor circuit 22 to switch the receiver to a monophonic mode of operation.

The window comparator 34 includes two comparators 36 and 38, each having a respective reference signal applied to one input and the output of low-pass filter 32 applied to the other input. The two reference signals are derived by a resistive voltage divider including three resistors 40, 42 and 44 connected in series between positive and negative supply rails. The voltages on either side of the central resistor 42 represent the limiting reference voltages. Comparator 36 has the positive reference voltage applied to its negative input, and the output of low-pass filter 32 applied to its positive input. Comparator 38, on the other hand, has the negative reference voltage applied to its positive input, and the output of low-pass filter 32 applied to its negative input.

As long as the level of noise within the low frequency slot of the Q channel is within the range bounded by the two reference voltage levels, the outputs of both comparators will be at low voltage levels. If the signal within the low frequency slot of the Q channel passes one of the thresholds, however, the output of the corresponding comparator will shift to a high voltage level. A high voltage level at a comparator output indicates that excessive interference is present and that the receiver should be switched to a monophonic mode of operation.

The outputs of the two comparators 36 and 38 are logic "OR"ed together by a circuit represented in FIG. 1 as an OR gate 46. The output of OR gate 46 will be at a high logic level whenever one of the outputs of comparators 36 and 38 is at a high voltage level. The output of OR gate 46 is applied to the "trigger" input of a retriggerable one-shot 48. Retriggerable one-shot 48 is held reset when the output of OR gate 46 is at a high logic level. The output of one-shot 48 is then also at a high logic level. When the output of OR gate 46 drops to a low voltage level, the retriggerable one-shot begins timing. After a preset interval, established by timing components (not shown) associated with the one-shot 48, the output of the one-shot drops to a low logic level. If, however, the output of OR gate 46 returns to a high logic level before the one-shot 48 times out, the retriggerable one-shot will again be reset and its output will remain high. The one shot will begin timing anew when next the output of OR gate 46 drops low. Thus, the output of retriggerable one-shot 48 will drop to a low logic level only when the output of OR gate 46 has remained low for more than the preselected interval of time.

The output of retriggerable one-shot 48 is applied to the input of an inverter 50 whose output is, in turn, applied to one input of a three-input AND gate 52. AND gate 52 controls the state of a single-pole, double-throw switch 54. The switch 54, although represented in FIG. 1 as a mechanical switch, is preferably a conventional solid state CMOS switch. The "toggle arm" of switch 54 is connected to one input of matrix circuit 20. One of the poles of switch 54 is connected to ground, whereas the other is connected to the output of the quadrature channel multiplier 26 through a high pass filter 56. High pass filter 56 has a cutoff frequency above the frequency of the pilot signal in the Q channel, hence the filtered Q signal applied to the switch 54 includes only the (L-R) portion of the Q channel signal.

As long as the output of AND gate 52 is at a low logic level, switch 54 is in the illustrated position wherein it connects the input to matrix 20 to ground. The receiver is then in a monophonic mode of operation since both outputs of matrix circuit 20 will then correspond to the I signal provided by the in-phase channel multiplier 24. The switch 54 is in the opposite position when the output of AND gate 52 is at a high logic level. When in the opposite position, the switch 54 connects the switched input of matrix 20 to the Q channel high pass filter 56. The Q signal is then matrixed with the I signal, whereby the receiver is in a stereophonic mode.

Whenever the output of the retriggerable one-shot 48 is at a high logic level, the output of inverter 50 is low, forcing the output of AND gate 52 also to a low logic level. As indicated previously, this condition will persist as long as the signal in the low frequency slot of the Q channel exceeds the thresholds established by the resistive divider (40, 42, 44). Consequently, the presence of excessive noise within the low frequency slot of the Q channel forces the receiver to a monophonic mode of reception.

AND gate 52 has two other inputs. The output of AND gate 52 will be low whenever any of its three inputs are low, and will thus only be high when all three of its inputs are high. One of the inputs of AND gate 52 is connected to the output of a pilot detector circuit, generally indicated at 58, whereas the other input of AND gate 52 is connected to the output of a lock detector circuit 60.

The lock detector circuit 60 has its input connected to the output of the in-phase channel multiplier 24, whereby it responds to the in-phase, or I channel signal. The output of the lock detector 60 will be at a high logic level only if a DC signal is present on its input. This, in turn, only occurs when the phase locked loop is locked onto the phase and frequency of the IF signal that is being demodulated. Consequently, AND gate 52 is disabled (forcing the receiver into a monophonic mode) during the time that the phase locked loop is not locked to the incoming signal. This prevents annoying beat notes from appearing in the output of the receiver during tuning of the receiver.

The pilot detector circuit 58 includes a bandpass filter 62 whose input is taken from the output of multiplier 26. Bandpass filter 62 has a passband centered on the frequency of the pilot signal, hence it passes only the pilot signal. The output of the bandpass filter 62 is applied to the input of an averaging circuit 64 through a rectifier 66. The output of the averaging circuit 64 has a DC level representative of the magnitude of the Q channel signal at the pilot signal frequency. If a pilot signal is present at this frequency, the output of averaging circuit 64 represents the average amplitude of the pilot signal. The output of averaging circuit 64 is applied to the positive input of a comparator 68. A reference or threshold level (again established by a resistive divider circuit) is applied to the negative input of the comparator. The output of comparator 68 is connected to one of the inputs of AND gate 52, and will be at a high level when the amplitude of the pilot signal exceeds the threshold and at a low level otherwise. Consequently, the output of AND gate 52 is forced to a low logic level whenever the pilot signal is either not present, or, although present, has an amplitude smaller than the threshold level.

In summary, the output signal provided by the AND gate 52 controls whether the receiver is in a monophonic or a stereophonic mode of reception. The AND gate is, in turn, controlled by three inputs such that it places the receiver in a stereophonic mode of operation only when (1) the phase locked loop is locked to the IF signal, (2) the pilot signal is present and has an amplitude greater than a preset threshold, and (3) the level of extraneous signals in the low frequency slot of the Q channel is below a preset threshold. At all other times the receiver operates in a monophonic mode.

Although the invention has been described with respect to a preferred embodiment, it will be appreciated that various rearrangements and alterations of parts may be made without departing from the spirit of the present invention, as defined in the appended claims.

What is claimed is:

1. Apparatus for use in an AM stereo demodulator having monophonic and stereophonic modes of operation and adapted to demodulate a QAM signal whose quadrature-phase signal has a low frequency slot containing substantially no information signal therein, and having a phase locked loop including a loop filter which filters the quadrature-phase signal, comprising means for comparing the amplitude of the filtered signal provided by said loop filter with at least one threshold level and for providing a first output signal when said amplitude is beyond said threshold, retriggerable timing means for providing a control signal having a first value as long as said first output signal is present and for a selected time interval thereafter and a second value otherwise, and means for holding said AM stereo demodulator in said monophonic mode when said control signal has said first value, regardless of whether the signal then being demodulated by said demodulator is a monophonic signal or a stereophonic signal.

2. Apparatus as set forth in claim 1, wherein said holding means comprises switch means coupled to said AM stereo demodulator, said switch means having a first state wherein said AM stereo demodulator is in a monophonic mode and a second state wherein said AM stereo demodulator is in a stereophonic mode, and control means for controlling the state of said switch means, said control means including said retriggerable timing means.

3. Apparatus as set forth in claim 2, wherein said control means further includes means for also holding said switch means in said first state as long as said phase locked loop is unlocked.

4. Apparatus as set forth in claim 3, wherein said control means further includes means for detecting a pilot signal in said input signal, and for also holding said switch means in said first state as long as said pilot signal is absent.

5. Apparatus as set forth in claim 1, wherein said comprising means comprises first means for comparing said filtered signal with a positive threshold and providing a second signal in accordance with said comparison, second means for comparing said filtered signal with a negative threshold and providing a third signal in accordance with said comparison, and means responsive to said second and third signals for providing said first output signal whenever said filtered signal is above said positive threshold or below said negative threshold.

* * * * *

UNITED STATES PATENT AND TRADEMARK OFFICE

CERTIFICATE OF CORRECTION

PATENT NO. : 4,504,966

DATED : March 12, 1985

INVENTOR(S) : David L. Hershberger

It is certified that error appears in the above-identified patent and that said Letters Patent is hereby corrected as shown below:

Column 6, line 42, change "comprising" to -- comparing --.

Signed and Sealed this

*Thirteenth* Day of *August 1985*

[SEAL]

*Attest:*

DONALD J. QUIGG

*Attesting Officer*

*Acting Commissioner of Patents and Trademarks*